US006495510B1

(12) United States Patent
Ofosu-Asante

(10) Patent No.: US 6,495,510 B1
(45) Date of Patent: Dec. 17, 2002

(54) FLUID CLEANING COMPOSITIONS HAVING HIGH LEVELS OF AMINE OXIDE

(75) Inventor: Kofi Ofosu-Asante, Cincinnati, OH (US)

(73) Assignee: Procter & Gamble, Cincinnati, OH (US)

( * ) Notice: Subject to any disclaimer, the term of this patent is extended or adjusted under 35 U.S.C. 154(b) by 0 days.

(21) Appl. No.: 09/678,446

(22) Filed: Oct. 3, 2000

Related U.S. Application Data

(60) Provisional application No. 60/157,630, filed on Oct. 4, 1999.

(51) Int. Cl.[7] ..... C11D 1/06; C11D 3/20; C11D 3/26

(52) U.S. Cl. ..... 510/503; 510/281; 510/283; 510/284; 510/351; 510/350; 510/356; 510/357

(58) Field of Search ..... 510/281, 283, 510/284, 351, 350, 356, 357, 503

(56) References Cited

U.S. PATENT DOCUMENTS

| | | | | | |
|---|---|---|---|---|---|
| 4,024,078 | A | | 5/1977 | Gilbert et al. | 252/551 |
| 4,391,726 | A | | 7/1983 | Koster | 252/99 |
| 4,470,923 | A | | 9/1984 | Koster | 252/547 |
| 4,576,728 | A | | 3/1986 | Stoddart | 252/102 |
| 4,783,283 | A | | 11/1988 | Stoddart | 252/547 |
| 4,938,893 | A | * | 7/1990 | Copeland et al. | 252/527 |
| 5,167,864 | A | * | 12/1992 | Borland et al. | 252/357 |
| 5,462,689 | A | | 10/1995 | Choy et al. | 252/90 |
| 5,478,500 | A | | 12/1995 | Swift et al. | 252/547 |
| 5,549,842 | A | | 8/1996 | Chang | 510/191 |
| 5,688,435 | A | | 11/1997 | Chang et al. | 252/187.25 |
| 5,691,291 | A | * | 11/1997 | Wierenga et al. | 510/214 |
| 5,698,505 | A | * | 12/1997 | Ofosu-Asante | 510/221 |
| 5,726,141 | A | * | 3/1998 | Ofosu-Asante | 510/220 |
| 5,849,039 | A | | 12/1998 | Sadlowski | 8/137 |
| 5,916,859 | A | | 6/1999 | Choy et al. | 510/195 |
| 5,929,009 | A | * | 7/1999 | Gambogi | 510/237 |
| 5,942,484 | A | | 8/1999 | Roetker et al. | 510/426 |
| 5,972,875 | A | * | 10/1999 | Crutcher et al. | 510/421 |
| 5,977,054 | A | * | 11/1999 | Wierenga | 510/503 |
| 5,990,064 | A | * | 11/1999 | Wierenga et al. | 510/214 |
| 6,069,122 | A | | 5/2000 | Vinson et al. | 510/235 |

* cited by examiner

*Primary Examiner*—Gregory Delcotto
(74) *Attorney, Agent, or Firm*—C. Brant Cook; Kim W. Zerby; Steve W. Miller

(57) ABSTRACT

Phase stable liquid compositions comprising preferred ratios of amine oxides and surfactants are provided. The compositions are preferably employed to spot clean stains from fabrics.

16 Claims, No Drawings

FLUID CLEANING COMPOSITIONS HAVING HIGH LEVELS OF AMINE OXIDE

This application claims priority under 35 USC 119(e) to 60/157,630, filed Oct. 4, 1999.

FIELD OF THE INVENTION

The present invention relates to fluid cleaning compositions for stain removal from stain garments, and in particular, to stain removal compositions for home dry cleaning processes.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

One type of home dry cleaning system comprises a carrier sheet containing various cleaning agents, and a plastic bag. The garments to be cleaned are placed in the bag together with the sheet, and then tumbled in a conventional clothes dryer. In a commercial embodiment, multiple single-use flat sheets and a single multi-use plastic bag are provided in a package. Unfortunately, such processes may not satisfactorily remove stains from heavily soiled or "spotted" areas of the fabrics being dry cleaned.

As is well known, soiled garments may be "pre-spotted" on localized areas using so-called "spot removal" compositions prior to cleaning or laundering. U.S. Pat. Nos. 5,942,484 and 5,849,039 disclose compositions wherein butoxy propoxy propanol (BPP) is a preferred cleaning solvent. However, the spot cleaning compositions disclosed therein do not perform favorably on oily and greasy stains.

Compositions having higher levels of amine oxides are known. U.S. Pat. Nos. 5,549,842; 5,916,859; 4,783,283; 5,688,435; 5,462,689 all disclose cleaning compositions having higher levels of amine oxides. However, these patents are all directed toward hard surface and bleaching compositions which are entirely unsuitable (due to the use of hypochlorite bleaches and abrasives) for use on the fine fabrics to which a spot cleaning formulation for home dry cleaning would typically be applied.

Accordingly, the need remains for fluid cleaning compositions that provide superior cleaning performance for oily/greasy stain removal while delivering lower levels of suds during cleaning than conventional fluid cleaning formulations.

SUMMARY OF THE INVENTION

This need is met by the present invention wherein a fluid cleaning composition demonstrating superior performance on oily/greasy stains is provided. The fluid cleaning compositions of the present invention provide superior performance as a stain cleaning formula fabrics. The superior performance benefits of the present invention is provided by elevated levels of amine oxides when used in conjunction with low levels of co-surfactant. In highly preferred compositions according to the present invention, the surfactant is an anionic surfactant at a level of less than about 5% by weight of the composition and more particularly an alkyl sulfate anionic surfactant and the amine oxide is used in a molar ratio of from about 5:4 to about 9:1 to the surfactant.

According to a first embodiment of the present invention, a fluid cleaning composition for superior oily/greasy stain removal is provided. The fluid cleaning composition comprises from about 0.01% to about 20% by weight of a tertiary amine oxide having the formula:

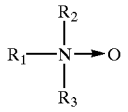

wherein $R_1$ is a $C_{10}$–$C_{25}$ linear or branched alkyl group, and $R_2$ and $R_3$ are independently selected from $C_1$–$C_4$ alkyl groups and $C_2$–$C_4$ hydroxy alkyl groups; from about 0.01% to about 5% by weight of the composition of a surfactant selected from the group consisting of anionic surfactants, nonionic surfactant, cationic surfactants, zwitterionic surfactants and mixtures thereof, preferably an alkyl sulfate anionic surfactant or alkyl ether carboxylates; and the balance detergent adjunct ingredients; wherein the molar ratio of amine oxide to total surfactant is from about 5:4 to about 9:1 and the composition is substantially free of halide bleaching agents.

According to a second embodiment of the present invention, a process for removing a stain from a localized stained area on a fabric, comprising the steps of placing the stained area of the fabric over and in contact with an absorbent stain receiver; applying a fluid cleaning composition to the stain from a container having a dispenser spout, the fluid cleaning composition comprising from about 0.01% to about 20% by weight of a tertiary amine oxide having the formula as described herein; from about 0.01% to about 5% by weight of the composition of anionic surfactant selected from the group consisting of anionic surfactants, and the balance detergent adjunct ingredients; wherein the molar ratio of amine oxide to total surfactant is from about 5:4 to about 9:1 and the composition is substantially free of halide bleaching agents; and concurrently or consecutively with step (b), rubbing or pressing the cleaning composition into the stain using the distal tip of the spout, whereby the stain is transferred into the stain receiver.

Accordingly, it is an object of the present invention to provide an improved fluid cleaning composition for stain cleaning. It is a further object of the present invention to provide a fluid cleaning composition having superior performance on oily/greasy stains via the use of elevated levels of amine oxides in relation to the surfactant system in the formula. It is yet another object of the present invention to provide a method of removing a stain from a stained fabric via the use of the compositions of the present invention. These and other objects, features and advantages of the present invention will be apparent from the following detailed description and the appended claims.

All percentages, ratios and proportions herein are by weight unless otherwise specified. All documents cited are, in relevant part, incorporated by reference.

DETAILED DESCRIPTION OF THE PREFERRED EMBODIMENTS

The fluid cleaning compositions of the present invention provide superior cleaning performance on greasy and oily stains. The compositions of the present invention achieve this improved performance via the use of elevated levels of amine oxide in conjunction with co-surfactants and in particular anionic surfactants. In addition, the total amount of surfactant is controlled such that excessive foaming on the cleaned fabrics does not occur. These fluid cleaning compositions provide particular advantages as stain removal formulas in home dry cleaning processes wherein the fabrics are not cleaned via an immersion cleaning but rather via a direct application of the cleaning formula to a stained fabric followed by drying in a home laundry dryer.

In a preferred method of cleaning of the present invention, the improved fluid cleaning composition is used in conjunction with the use of an absorbent stain receiver and is releasably housed within a container which is provided with a dispensing means. (The combination of container and its dispensing means is herein referred to conjointly as the "dispenser"). In the process of this invention, a fabric is inspected for any localized area of stain. The stained area is then placed in close contact with an absorbent stain receiver and treated by means of the dispenser.

Fluid Cleaning Composition

The fluid cleaning composition of the present invention comprises the combination of amine oxides at elevated levels with a surfactant system, and in particular anionic surfactants. The amine oxides for use in the present invention are preferably tertiary amine oxides having the formula:

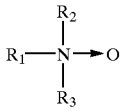

wherein $R_1$ is a $C_{10}$–$C_{25}$ linear or branched alkyl group, and each of $R_2$ and $R_3$ are independently selected from $C_1$–$C_4$ alkyl groups and $C_2$–$C_4$ hydroxy alkyl groups. In preferred embodiments, $R_1$ is a $C_{12}$–$C_{18}$ linear alkyl group and $R_2$ and $R_3$ are preferably methyl groups. The $R_1$ group may be linear or branched and may be derived from natural or synthetic sources. For the purposes of the present invention, linear groups are defined as including moieties incorporating up to about 25% methyl branching. Chain lengths as disclosed herein are average chain lengths and therefore the amine oxides may contain mixtures of various chain lengths. Amine oxides according to present invention are commercially available from a number of sources including The Procter & Gamble Company of Cincinnati, Ohio.

The amine oxides of the present invention are present in an amount of from about 0.01% to about 20% by weight of the composition, with amounts of from about 0.01% to about 10% being more preferred and amounts of from 0.1% to about 5% being even more preferred and 0.1% to about 1% being the most preferred range. The amine oxide is used in conjunction with the co-surfactants of the present invention at a molar ratio of amine oxide to surfactant of from about 5:4 to about 9:1 with molar ratios of from about 5:4 to about 7:1 being more preferred and 5:3 to about 6:1 being the most preferred.

The surfactants of the present invention may be selected from nonionic, anionic, cationic and zwitterionic surfactants. Anionic or nonionic surfactants are the preferred surfactants to be employed in conjunction with the amine oxide of the present invention. Suitable anionic surfactants include any of the conventionally known anionic surfactants as described herein but preferably are selected from alkylbenzene sulfonates, alkyl sulfates, mid-chain branched alkyl sulfates, and alkyl ether carboxylates.

Alkyl sulfate surfactants for use in the present invention are water soluble salts or acids of the formula ROSO3M wherein R preferably is a C10–C24 hydrocarbyl, preferably an alkyl or hydroxyalkyl having a C10–C20 alkyl component, more preferably a C12–C18 alkyl or hydroxyalkyl, and M is H or a cation, e.g. an alkali (Group IA) metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Alternatively, an alkaline earth metal (Group IIA) such as magnesium, divalent organic diamines, and mixture thereof can be used as the counterion in this invention. Typically, alkyl chains of C12–16 are preferred for lower wash temperatures (e.g., below about 50° C.) and C16–18 alkyl chains are preferred for higher wash temperatures (e.g., above about 50° C.).

Another suitable type of alkyl sulfate surfactant according to the present invention are the secondary (2,3) alkyl sulfates. These surfactants preferably are of the formula:

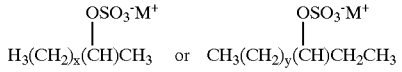

wherein x and (y+1) are integers of at least about 7, preferably at least about 9. Preferably these surfactants contain from 10 to 18 carbon atoms. Suitable examples of these anionic surfactants are disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

Another suitable type of alkyl sulfate surfactant according to the present invention are the alkyl alkoxylated sulfate. These surfactants are water soluble salts or acids typically of the formula RO(A)mSO3M wherein R is an unsubstituted C10–C24 alkyl or hydroxyalkyl group having a C10–C24 alkyl component, preferably a C12–C20 alkyl or hydroxyalkyl, more preferably C12–C18 alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are C12–C18 alkyl polyethoxylate (1.0) sulfate, C12–C18 alkyl polyethoxylate (2.25) sulfate, C12–C18 alkyl polyethoxylate (3.0) sulfate, and C12–C18 alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching. The anionic surfactant component may comprise alkyl sulfates and alkyl ether sulfates derived from conventional alcohol sources, e.g., natural alcohols, synthetic alcohols such as those sold under the trade name of NEODOL™, ALFOL™, LIAL™, LUTENSOL™ and the like. Alkyl ether sulfates are also known as alkyl polyethoxylate sulfates.

Another type of alkyl sulfate surfactant according to the present invention are one or more (preferably a mixture of two or more) mid-chain branched surfactants, preferably mid-chain branched alkyl alkoxy alcohols having the formula:

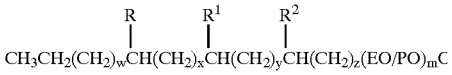

mid-chain branched alkyl sulfates having the formula:

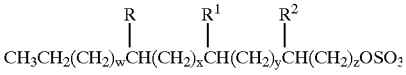

and mid-chain branched alkyl alkoxy sulfates having the formula:

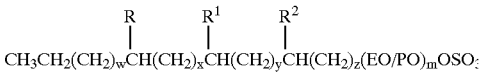

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w +x+y+z is from 8 to 14. EO and PO represent ethyleneoxy units and propyleneoxy units having the formula:

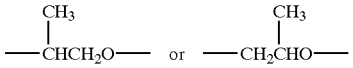

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

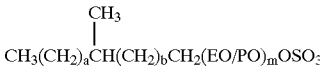

or the formula:

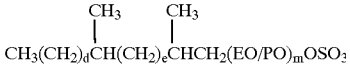

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants. Mixtures of these branched surfactants with conventional linear surfactants are also suitable for use in the present compositions.

Of the anionic surfactants according to the present invention which are not included in the alkyl sulfates according to the present invention one type of anionic surfactant which can be utilized encompasses alkyl ester sulfonates. These are desirable because they can be made with renewable, non-petroleum resources. Preparation of the alkyl ester sulfonate surfactant component can be effected according to known methods disclosed in the technical literature. For instance, linear esters of C8–C20 carboxylic acids can be sulfonated with gaseous SO3 according to "The Journal of the American Oil Chemists Society," 52 (1975), pp. 323–329. Suitable starting materials would include natural fatty substances as derived from tallow, palm, and coconut oils, etc.

The alkyl ester sulfonate surfactant, especially for laundry applications, comprises alkyl ester sulfonate surfactants of the structural formula:

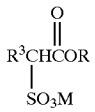

wherein $R_3$ is a C8–C20 hydrocarbyl, preferably an alkyl, or combination thereof, $R_4$ is a C1–C6 hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Preferably, $R_3$ is C10–C16 alkyl, and $R_4$ is methyl, ethyl or isopropyl. Especially preferred are the methyl ester sulfonates wherein $R_3$ is C14–C16 alkyl.

Particularly preferred in the present invention are alkylbenzenesulphonates. These include the hard (ABS, TPBS), linear types, also known as LAS, and made by known process such as various HF or solid HF e.g., DETAL® (UOP) process, or made by using other Lewis Acid catalysts e.g., $AlCl_3$, or made using acidic silica/alumina or made from chlorinated hydrocarbons, such as $C_9$–$C_{20}$ linear alkylbenzene sulfonates, particularly sodium linear alkyl $C_{10}$–$C_{15}$ benzene sulfonate. These surfactants are water soluble salts or acids typically of the formula RASO3M wherein R is a branched or linear C10–C24 alkyl group, preferably a C10–C20 alkyl, more preferably C10–C18 alkyl, A is an aryl group, preferably benzene, or toluene, more preferably benzene unit, and M is H or a cation which can be, for example, a metal cation (e.g., sodium, potassium, lithium, etc.), ammonium or substituted-ammonium cation.

The surfactant systems of the laundry detergent compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) modified alkyl arylsulfonate surfactants, or MLAS preferably surfactants wherein the aryl unit is a benzene ring having the formula:

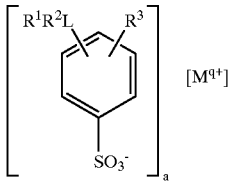

wherein L is an acyclic hydrocarbyl moiety comprising from 6 to 18 carbon atoms; $R^1$, $R^2$, and $R^3$ are each independently hydrogen or $C_1$–$C_3$ alkyl, provided $R^1$ and $R^2$ are not attached at the terminus of the L unit; M is a water soluble cation having charge q wherein a and b are taken together to satisfy charge neutrality. Mixtures of these modified surfactants with conventional surfactants and/or branched surfactants, such as those described herein, are also suitable for use in the present compositions.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Other anionic surfactants useful in the present invention can also be included herein. These can include salts (including, for example, sodium, potassium, ammonium, and substituted ammonium salts such as mono-, di- and triethanolamine salts) of soap, C8–C22 primary or secondary alkanesulphonates, C8–C24 olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated C12–C18 monoesters) diesters of sulfosuccinate (especially saturated and unsaturated C6–C14 diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula RO(CH2CH2O)kCH2COO−M+ wherein R is a C8–C22 alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

The surfactant system of the present invention is employed at levels of from about 0.01% to about 5% by weight of the composition, more preferably from about 0.05% to about 3% and most preferably 0.1% to about 0.7% by weight of the composition. Anionic surfactant levels higher than 5% are in general unfavorable in the present invention as they generate an unacceptable high level of suds in the fabrics cleaned with the fluids of the present invention.

In addition to the amine oxide and preferably anionic surfactant, the compositions of the present invention optionally, but preferably comprise a diamine, preferably an organic diamine. If a diamine is present in the compositions of the present invention, it is preferably present at a level of from about 0.25% to about 15%, more preferably from about 0.30% to about 5%, most preferably from about 0.30% to about 2% by weight of the composition.

Preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3 propane diamine (pK1=10.5; pK2=8.8), 1,6 hexane diamine (pK1=11; pK2=10), 1,3 pentane diamine (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2—As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, N.Y. and London, 1975. Additional information on pKa's can be obtained from relevant company literature, such as information supplied by Dupont, a supplier of diamines.

As a working definition herein, the pKa of the diamines is specified in an all-aqueous solution at 25.degree. C. and for an ionic strength between 0.1 to 0.5M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, N.Y., 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., JEFFAMINE EDR 148®, (namely 1,2-bis(2-aminoethoxy)ethane). In addition, materials based on ethylene diamine are unsuitable.

The diamines useful herein can be defined by the following structure:

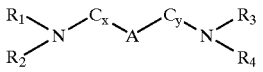

wherein $R_{1-4}$ are independently selected from H, methyl, ethyl, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater, preferably 2 or greater.

Examples of preferred diamines include the following:

Dimethyl aminopropyl amine

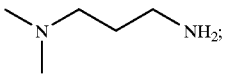

1,6-Hexane diamine

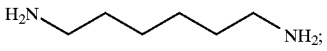

1,3-Propane diamine

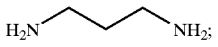

2-Methyl 1,5-pentane diamine

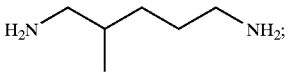

1,3-Pentadiamine, available under the tradename DYTEK EP

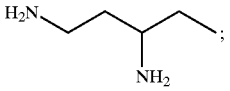

1-Methyl-diaminopropane or 1,3-Diaminobutane

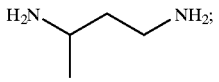

JEFFAMINE EDR 148®, (1,2-bis(2-aminoethoxy)ethane

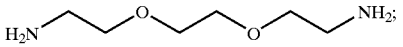

Isophorone diamine

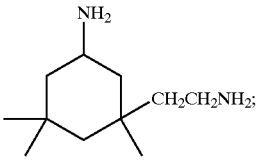

1,3-bis(methylamine)-cyclohexane or 1,3-cyclohexanebis(methylamine)

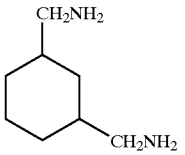

and mixtures thereof.

When tested as approximately equimolar replacements for Ca/Mg in the near neutral pH range (7–8), the organic diamines provided only parity grease cleaning performance to Ca/Mg. This achievement is not possible through the use of Ca/Mg or through the use of organic diamines below pH 8 or through the use of organic diamine diacid salts below pH 8.

The balance of the fluid cleaning composition of the present invention comprises detergent adjunct ingredients in general and are preferably selected from the group consisting of water, solvents, chelants, malodor control agents, silicone wetting agents and mixtures thereof. Of course, other detergent adjuncts such as perfumes, suds suppressors, antistatic agents, anti-microbial agents and the like may be included as well.

One problem associated with known fabric pre-spotting compositions is their tendency to leave visible residues on fabric surfaces. Such residues are problematic and are preferably to be avoided herein since the present preferred process does not involve conventional immersion or rinse steps. Accordingly, the fluid cleaning compositions herein should, most preferably, be substantially free of various polyacrylate-based emulsifiers, polymeric anti-static agents, inorganic builder salts and other residue-forming materials, except at low levels of about 0.1%–0.3%, and preferably 0%, of the final compositions. Stated otherwise the compositions herein should be formulated so as to leave substantially no visible residue on fabrics being treated according to the practice of this invention.

Accordingly, in a preferred aspect of this invention there are provided liquid fluid cleaning (i.e., spot-cleaning) compositions which are substantially free of materials which leave visible residues on the treated fabrics. This necessarily means that the preferred pre-spotting compositions are formulated to contain the highest level of volatile materials possible, preferably water, typically about 95%, preferably about 97.7%, and an optional but preferred cleaning solvent such as butoxypropoxy propanol (BPP) at a low, but effective, level, typically about 1% to about 4%, preferably about 2%. Advantageously, when thus formulated such compositions exist as aqueous solutions rather than as suspensions or emulsions. Thus, such compositions do not require use of additional emulsifiers, thickening agents, suspending agents, and the like, all of which can contribute to the formation of undesirable visible residues on the fabric.

Indeed, as an overall proposition, any of the chemical compositions which are used to provide the pre-spotting function herein comprise ingredients which are safe and effective for their intended use, and, as noted above, preferably do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

In addition to the foregoing considerations, the compositions used herein are preferably formulated such that they are easily dispensed and not so adhesive in nature that they render dispensing from the container to be unhandy or difficult. However, and while not intending to be limiting of the present invention, the preferred compositions disclosed herein afford a spot-cleaning process which is both effective and aesthetically pleasing when used in the manner disclosed herein.

The compositions herein may optionally comprise from about 0.25% to about 7%, by weight, of hydrogen peroxide. Preferred fluid cleaning compositions will comprise 0.5 to about 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner. However, due to the use of the compositions of the present invention as a stain removal or cleaning solution, the compositions herein shall be substantially free of halide based bleaching agents, such as chloride, bromides, hypochlorates, hypochlorites, and various bleaching agents. By substantially free, it is intended that present invention shall contain less than about 0.5% by weight of halide bleaching agents.

The compositions herein may comprise minor amounts of various optional ingredients, including bleach stabilizers, perfumes, brighteners, pH control agents, preservatives, and the like. If used, such optional ingredients will typically comprise from about 0.05% to about 2%, by weight, of the compositions, having due regard for residues on the cleaned fabrics.

The compositions herein may also optionally include a chelating agent, particularly in peroxide containing formulas. The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01–1%) in commercial sources of hydrogen peroxide. A variety of phosphonate chelators are known in stabilizing $H_2O_2$. The amino phosphonates are especially useful for this purpose. Various amino phosphonates are available as under the DEQUEST® trade name from the Monsanto Company, St. Louis, Mo. Representative, but non-limiting, examples include ethylenediamine tetrakis (methylene phosphonic) acid, diethylenetriamine penta(methylene phosphonic) acid, and the water-soluble salts thereof. Amino tris(methylene phosphonic) acid or its water-soluble salts (as DEQUEST 2000®) is a preferred chelator.

The pH range of the compositions helps provide stability is typically in the acid-slightly basic range from about 3 to about 11, preferably about 7–9.

The preferred solvent herein is butoxy propoxy propanol (BPP) which is available in commercial quantities as a mixture of isomers in about equal amounts. The isomers, and mixtures thereof, are useful herein. The isomer structures are as follows:

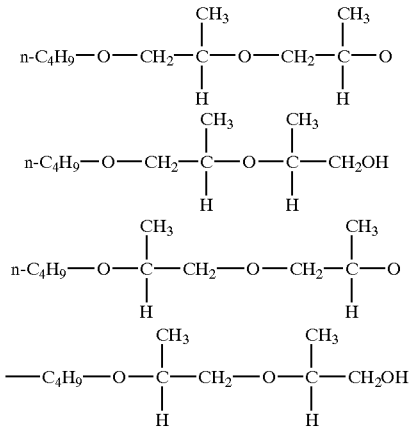

Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein. Other solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such solvents or co-solvents will typically comprise from about 0.5% to about 2.5%, by weight, of the aqueous compositions herein.

As discussed herein, the compositions of the present invention may be employed in a process for removing a stain from a localized stained area on a fabric, comprising the steps of placing the stained area of the fabric over and in contact with an absorbent stain receiver; applying a fluid cleaning composition to said stain from a container having a dispenser spout.

The stain receiver which is used in the pre-spotting operation herein can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils thick. It optionally, but preferably, has a barrier film on its rear surface to prevent the cleaning liquid from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer. Additional stain receivers which may be employed in the present invention are disclosed in U.S. Pat. No. 5,489,039, the disclosure of which is herein incorporated by reference.

Another type of stain receiver for use herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-spotting, the stained area of the garment or fabric swatch is placed over a section of the stain receiver, followed by treatment with the liquid cleaning solution in conjunction with the tip of the dispenser tube to provide mechanical agitation. Repeated manipulations with the tip and the detergency effect of the solution serve to loosen the soil and transfer it to the receiver. While spot cleaning progresses, the suction effects of the receiver capillaries cause the cleaning solution and stain debris to be carried into the receiver, where the stain debris is largely retained. At the end of this step the stain as well as almost all of the cleaning solution is found to have been removed from the fabric being treated and transferred to the receiver. This leaves the fabric surface only damp, with a minimum residue of the cleaning solution/stain debris which can lead to undesirable rings on the fabrics.

A typical dispenser herein has the following dimensions, which are not to be considered limiting thereof. The volume of the container bottle used on the dispenser is typically 2 oz.–4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal of 0.182 inches (4.6 mm). The diameter of the channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal end of the spout.

The following examples are representative, but by no means limiting of the present invention.

EXAMPLE I

The following fluid compositions according to the present invention were prepared.

| Ingredients | Conventional | A | B | C | D | E |
|---|---|---|---|---|---|---|
| Alkyl Ethoxy Sulfate | 0.29 | 0.04 | 0.16 | 0.04 | 0.16 | 0.26 |
| $C_{23}$ Dimethly Amine Oxide | 0.04 | 0.29 | 0.58 | 0.29 | 0.58 | 0.97 |
| Citric Acid | | 0.01 | 0.01 | 0.01 | 0.01 | 0.01 |
| Mg source | 0.045 | 0.045 | 0.045 | 0.045 | 0.045 | 0.045 |
| BPP | 2.0 | 2.0 | 2.0 | 2.0 | 2.0 | 2.0 |
| Preservative | 0.0003 | 0.0003 | 0.0003 | 0.0003 | 0.0003 | 0.0003 |
| TEA | — | 0.10 | 0.12 | — | — | 0.14 |
| NaOH | 0.01 | — | — | 0.006 | 0.01 | — |
| Water | to balance | to balance | to balance | to balance | to balance | to balance |

The compositions as disclosed above were compared for spot cleaning performance on various greasy and oily stains using the method of the present invention and identical stain receiver pads as disclosed above. The compositions were tested on identical stains and graded by a panel of 3–5 panelists on a scale of from −4 to +4 with the average of the scores being the score reported. The compositions of the present invention were compared to the conventional formula and scores assigned on the basis of 0=No Difference; 1=I think I see an improvement; 2=I know I see an improvement; 3=I see a clear improvement and 4=I see a very clear improvement. The data reported represents average scores and significance is calculated via commercially available software. Negative performance versus the base conventional formula is reported by negative scores. The results of this comparative testing is reported as follows:

| Stain Type/Fabric | Conventional | A | B | C | D | E | LSD (90) |
|---|---|---|---|---|---|---|---|
| Butter/Cotton | 0.00 | 0.03 | 1.17 | 1.81 | 1.67 | 1.08 | 1.4 |
| Hamburger Grease/Cotton | 0.00 | 1.56 | 1.50 | 1.75 | 2.25 | 2.19 | 0.9 |
| Lipstick/Rayon | 0.00 | 0.36 | 1.25 | 0.83 | 1.42 | 2.69 | 1.1 |
| Lipstick/Silk | 0.00 | 1.03 | 1.56 | 0.17 | 2.42 | 2.22 | 1.7 |

As can be seen, the compositions of the present invention demonstrate superior cleaning performance on greasy and oily stains as compared to conventional cleaning solutions.

EXAMPLE II

The following fluid compositions according to the present invention are prepared.

| Ingredients | Conventional | A | B | C | D | E |
|---|---|---|---|---|---|---|
| Alkyl Ethoxy sulfate | 0.29 | 0.04 | 0.16 | 0.04 | 0.16 | 0.26 |
| $C_{16}$ Dimethly Amine Oxide | 0.04 | 0.29 | 0.58 | 0.29 | 0.58 | 0.97 |
| Citric Acid | | 0.01 | 0.01 | 0.01 | 0.01 | 0.01 |
| Mg source | 0.045 | 0.045 | 0.045 | 0.045 | 0.045 | 0.045 |
| BPP | 2.0 | 2.0 | 2.0 | 2.0 | 2.0 | 2.0 |
| Preservative | 0.0003 | 0.0003 | 0.0003 | 0.0003 | 0.0003 | 0.0003 |
| TEA | — | 0.10 | 0.12 | — | — | 0.14 |
| NaOH | 0.01 | — | — | 0.006 | 0.01 | — |
| Water | to balance | to balance | to balance | to balance | to balance | to balance |

EXAMPLE III

The following fluid compositions according to the present invention are prepared.

| Ingredients | Conventional | A | B |
|---|---|---|---|
| Alkyl sulfate | 0.29 | 0.050 | 0.035 |
| Amine Oxide | 0.04 | 0.45 | 0.285 |
| Citric Acid | 0.00 | 0.060 | 0.0375 |
| Diamine | 0.00 | 0.070 | 0.045 |
| BPP | 2.0 | 0.0 | 2.0 |
| Preservative | 0.0003 | 0.0003 | 0.0003 |
| Water | to balance | to balance | to balance |

The compositions as disclosed above were compared for spot cleaning performance on various greasy and oily stains using the method of the present invention and identical stain receiver pads as disclosed above. The compositions were tested on identical stains and graded by a panel of 3–5 panelists on a scale of from −4 to +4 with the average of the scores being the score reported. The compositions of the present invention were compared to the conventional formula and scores assigned on the basis of 0=No Difference; 1=I think I see an improvement; 2=I know I see an improvement; 3=I see a clear improvement and 4=I see a very clear improvement. The data reported represents average scores and significance is calculated via commercially available software. Negative performance versus the base conventional formula is reported by negative scores. The results of this comparative testing is reported as follows:

| Stain type/Fabric | Conventional | A | B | LSD (95) |
|---|---|---|---|---|
| Butter/silk | 0.00 | 1.33 | 2.78 | 0.50 |
| Hamburger grease/silk | 0.00 | 1.00 | 2.22 | 0.50 |
| Lipstick/wool | 0.00 | 4.15 | 2.85 | 0.38 |
| Makeup/wool | 0.00 | 4.26 | 3.52 | 0.58 |
| Beef gravy/silk | 0.00 | −0.11 | 1.00 | 2.14 |
| Spaghetti sauce/rayon | 0.00 | −1.19 | −0.48 | 0.99 |
| Spaghetti sauce/wool | 0.00 | 0.78 | 0.67 | 0.78 |

EXAMPLE IV

The following fluid composition according to the present invention is prepared.

| Ingredients | Conventional | A |
|---|---|---|
| Alkyl sulfate | 0.29 | 0.035 |
| Amine Oxide | 0.04 | 0.285 |
| Citric Acid | 0.00 | 0.038 |
| Diamine | 0.00 | 0.045 |
| BPP | 2.0 | 2.0 |
| Preservative | 0.0003 | 0.0 |
| Water | to balance | to balance |

What is claimed is:

1. A fluid cleaning composition comprising:

a) a tertiary amine oxide having the formula:

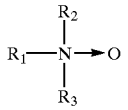

wherein $R_1$ is a $C_{10}$–$C_{25}$ linear or branched alkyl group, and $R_2$ and $R_3$ are independently selected from $C_1$–$C_4$ alkyl groups and $C_2$–$C_4$ hydroxy alkyl groups;

b) an alkyl ethoxy sulfate surfactant;

c) a diamine; and d) optionally, a detergent adjunct ingredient wherein the molar ratio of amine oxide (a) to surfactant (b) is from about 5:4 to about 9:1.

2. The composition according to claim 1 wherein said composition is substantially free of halide bleaching agents.

3. The composition according to claim 1 wherein the composition further comprises a solvent.

4. The composition according to claim 3 wherein the solvent comprises butoxy propoxy propanol.

5. The composition according to claim 1 wherein the composition comprises from about 0.01% to about 20% by weight of the composition of the amine oxide.

6. The composition according to claim 1 wherein the composition comprises from about 0.01% to about 5% by weight of the composition of the surfactant.

7. The composition according to claim 1 wherein the composition further comprises magnesium ions.

8. The composition according to claim 1 wherein said molar ratio of the amine oxide to the surfactant is from about 3:2 to about 5:1.

9. The composition according to claim 1 wherein in said $R_2$ and $R_3$ and $C_1$–$C_2$ alkyl and $R_1$is $C_{12}$–$C_{18}$ alkyl.

10. The composition according to claim 1 further comprising an anionic surfactant selected from the group consisting of alkyl sulfate, alkyl ethercarboxylates, methyl ester sulfonates, and alkyl glycerol sulfonates and mixtures thereof.

11. The composition according to claim 10 wherein said anionic surfactant is selected from alkyl sulfates.

12. The composition according to claim 1 wherein said detergent adjunct ingredient is selected from the group consisting of water, solvents, chelants, malodor control agents, and silicone wetting agents.

13. The composition according to claim 1 wherein the diamine comprises a low molecular weight organic diamine having a pK1 and a pK2, wherein the pK1 and the pK2 of said diamine are both in the range of from about 8.4 to about 11.5.

14. The composition according to claim 13 wherein the diamine is selected from the group consisting of:

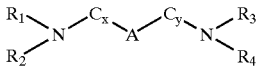

wherein $R_{1-4}$ are independently selected from H, methyl, ethyl, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range; wherein if A is present, then x and y must both be 1 or greater.

15. The composition according to claim 13 wherein said diamine is selected from the group consisting of:

Dimethyl aminopropyl amine

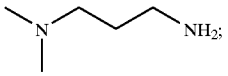

1,6-Hexane diamine

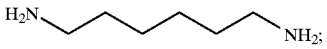

1,3-Propane diamine

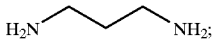

2-Methyl 1,5-pentane diamine

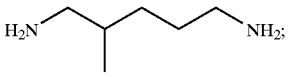

1,3-Pentadiamine

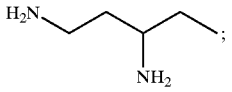

1-Methyl-diaminopropane or 1,3-Diaminobutane

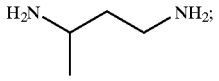

1,2-bis(2-aminoethoxy)amine

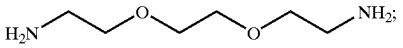

Isophorone diamine

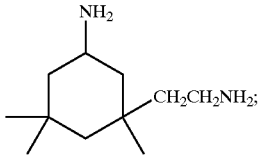

1,3-bis(methylamine)-cyclohexane or 1,3-cyclohexanebis(methylamine)

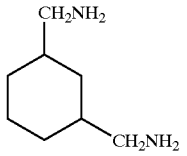

and mixtures thereof.

16. The composition according to claim 15 wherein said diamine is 1,3-cyclohexanebis(methylamine).

* * * * *

UNITED STATES PATENT AND TRADEMARK OFFICE

CERTIFICATE OF CORRECTION

PATENT NO. : 6,495,510 B1
DATED : October 3, 2000
INVENTOR(S) : Kofi Ofosu-Asante It is certified that error appears in the above-identified patent and that said Letters Patent is hereby corrected as shown below:

Column 16,
Line 50, please omit the word "in"
Line 50, please replace "and" with -- are --

Signed and Sealed this

Eighth Day of July, 2003

JAMES E. ROGAN
*Director of the United States Patent and Trademark Office*